United States Patent [19]

Clawson

[11] Patent Number: 4,764,193

[45] Date of Patent: Aug. 16, 1988

[54] THERMOELECTRIC FROST COLLECTOR FOR FREEZERS

[75] Inventor: Lawrence G. Clawson, Dover, Mass.

[73] Assignee: Raytheon Company, Lexington, Mass.

[21] Appl. No.: 105,778

[22] Filed: Oct. 7, 1987

[51] Int. Cl.[4] ..... F25B 21/02

[52] U.S. Cl. ..... 62/3; 62/140; 62/272; 62/283; 62/441

[58] Field of Search ..... 62/283, 440–441, 62/272, 3, 140

[56] References Cited

U.S. PATENT DOCUMENTS

| | | | |
|---|---|---|---|
| 2,561,305 | 7/1951 | Limpert et al. | 62/283 |
| 3,008,306 | 11/1961 | Hiler | 62/283 |
| 3,108,450 | 10/1963 | Crotser | 62/283 X |
| 3,973,938 | 8/1976 | Szabo et al. | 62/3 |
| 4,191,024 | 3/1980 | Machida | 62/80 |
| 4,294,081 | 10/1981 | Mitani et al. | 62/283 X |
| 4,297,850 | 11/1981 | Reed | 62/3 |
| 4,586,342 | 5/1986 | Morishita et al. | 62/3 |

OTHER PUBLICATIONS

"Physics"; N.Y.; E. Hausmann and E. P. Slack; D. Van Nostrand Co., Inc.; 2/1944; p. 747.

*Primary Examiner*—Lloyd L. King

*Attorney, Agent, or Firm*—Richard Sharkansky; William R. Clark

[57] ABSTRACT

A thermoelectric heat pump attached to a plate evaporator within the freezer compartment. The surface area of the thermoelectric device is maintained at a temperature substantially lower than the temperature of the evaporator plate during the cooling cycle. Accordingly, the majority of frost is collected on the thermoelectric surface area. Defrost is accomplished by reversing the voltage potential across the thermoelectric device and draining the water away in a suitable manner.

14 Claims, 3 Drawing Sheets

THERMOELECTRIC FROST COLLECTOR FOR FREEZERS

BACKGROUND OF THE INVENTION

The field of the invention relates to prevention of frost build-up within a freezer compartment.

One common approach of cooling freezers and refrigerators is to use a tube and fin evaporator. In a conventional configuration, the tube and fin evaporator is positioned in a small chamber external to the freezer and refrigerator compartments, and a fan is used to recirculate air from the respective compartments through ducts past the evaporator. Typically, the fan and the compressor are controlled by the temperature setting of the freezer, and the temperature of the refrigerator is controlled by a manual or thermostat controlled throttle in the air duct communicating therewith. As is well known, it is undesirable to have ice accumulate on the outside of the evaporator because it causes the efficiency of the thermal transfer to decrease. To eliminate the ice or frost, the evaporator typically has an electric heater that is periodically energized during compressor off-time to melt the ice.

One problem with the above described evaporator configuration is that it normally adds at least 2 inches to the height of the refrigerator/freezer. Stated differently, for a given refrigerator/freezer height, approximately one cubic foot of otherwise usable space may be lost to the evaporator chamber, fan, and associated ducting. A smaller tube or fin evaporator could be used in the above-described refrigerator/freezer to reduce space but it would increase refrigerator/freezer overall energy consumption.

Another approach of cooling freezers is to use a plate evaporator system. Rather than cooling by circulating air through ducts, the refrigerator and freezer walls themselves are partially fabricated from aluminum containing evaporator tubes. The wall surfaces become very cold and heat is transferred to them substantially by thermal radiation. This approach has an important advantage of saving space due to the elimination of the evaporator chamber, fan, and ducts. Also, the unit runs quieter. Further, elimination of fans generally saves over ½ Kw/hr/day in energy. The reliability is also increased because fewer components are used.

However, a plate evaporator system has a serious disadvantage in that ice or frost is much more difficult to remove than with the above described tube-and-fin evaporator. Because the plate evaporator actually makes up at least part of the walls of the freezer compartment, the entire freezer compartment rather than the external evaporator, must be raised above 32° F. to remove the ice. To do this, the freezer is generally turned off for some period of time. Not only is this procedure bothersome, but it also decreases the operating efficiency of the plate evaporator system.

SUMMARY OF THE INVENTION

In accordance with the present invention, a refrigeration device is provided with a thermally insulated compartment, means for cooling the compartment comprising a cooling surface having a predetermined temperature, and means for collecting frost in the compartment, the frost collecting means comprising a frost collecting surface having a temperature colder than the predetermined temperature. It may be preferable that the invention further comprises means for periodically raising the temperature of the collecting means above freezing to melt the frost into water. The refrigeration device could further comprise means for removing the water from the compartment. It may be preferable that the collecting means comprises a thermoelectric heat pump module.

The invention may also be practiced by the method of defrosting a freezer compartment having an evaporator with a heat exchange surface and a thermoelectric device with a heat exchange surface comprising the steps of cooling the thermoelectric surface to a temperature below the evaporator surface wherein a substantial portion of the frost forming in the freezer forms on the thermoelectric surface and periodically raising the temperature of the device to melt the frost, thereby producing water. It may be preferable that the method further comprise the step of removing the water from the compartment.

In one embodiment of the invention, a thermoelectric heat pump module having a thickness of 0.25 inches and a surface area of 1–2 square inches is attached to the freezer evaporator plate wall. This device, which operates on +5V dc and uses about 10W, pumps heat by lowering the temperature of one surface relative to the opposite by differentials of over 20° F. for modest wattage heat loads. The cold surface collects frost in the compartment, thereby substantially limiting the build up of frost on the evaporator. At this low level of energy consumption, the heat pump module gathers sufficient frost without significantly adding to the freezer evaporator cooling load. Removal of frost from the heat pump module occurs by reversing the dc voltage and quickly raising the cold surface to approximately 40° F. to melt the frost formed thereon. A drain is provided to carry the water away.

BRIEF DESCRIPTION OF THE DRAWINGS

The above-mentioned and other features of the invention will now be more apparent by reading the description of the preferred embodiment with reference to the drawings wherein.

DESCRIPTION OF THE PREFERRED EMBODIMENTS

Figure 1:
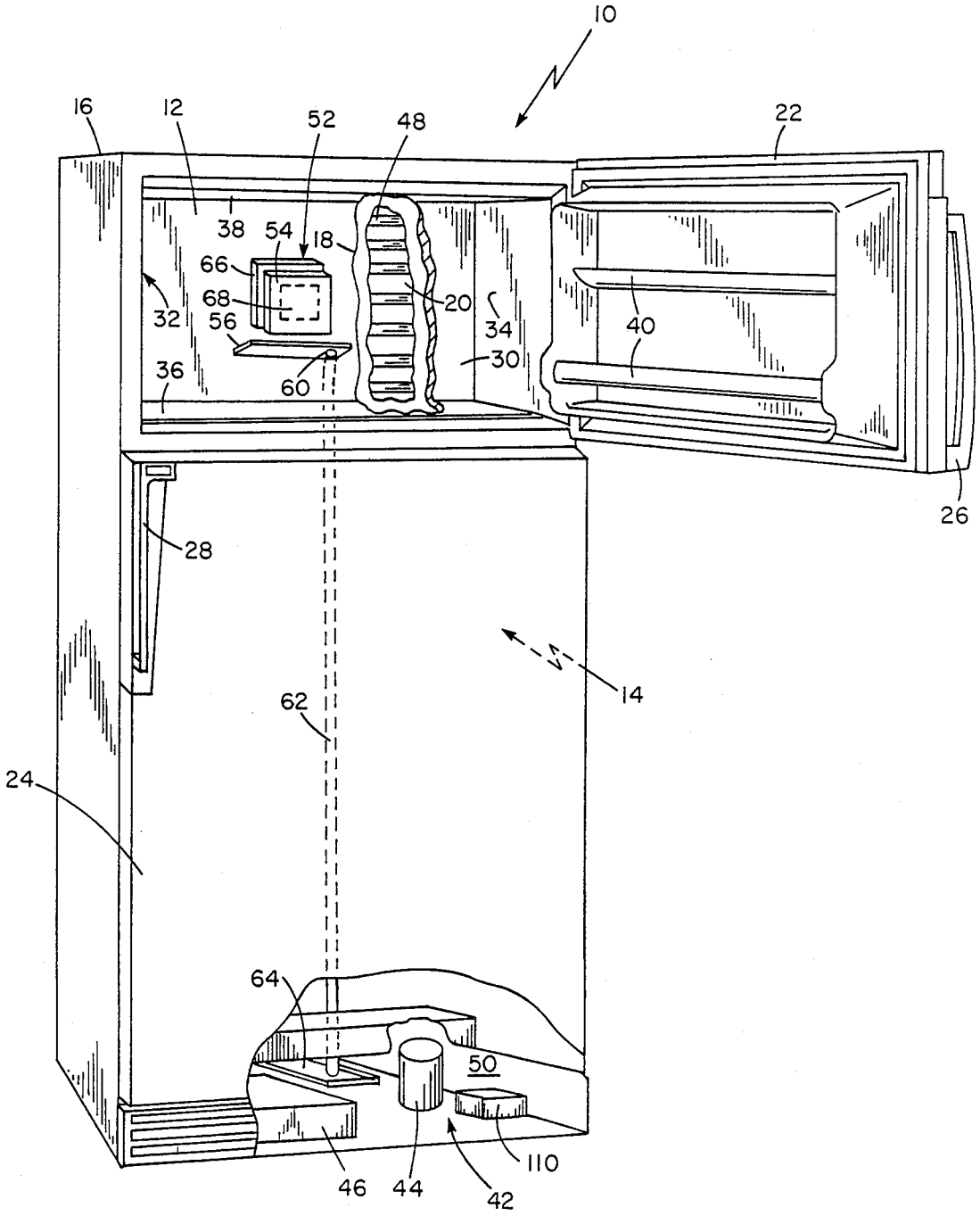
FIG. 1 is a partially broken away front perspective view of a refrigerator in accordance with the invention.

Referring to FIG. 1, there is shown a front pictorial view of a top mount refrigerator 10 with a freezer compartment 12 or cavity partially broken away. As is well known, a top mount refrigerator 10 includes a top freezer compartment 12 positioned above a bottom refrigerator compartment 14. Refrigerator 10 has an outer metal cabinet 16 or case, an inner liner 18, and an insulation material 20 sandwiched therebetween. The refrigerator 10 also includes a door 22 for freezer compartment 12 and door 24 for refrigeration compartment 14. Each door 22 and 24 has a respective handle 26 and 28 for opening. Freezer compartment 12 has a back wall 30, two side walls 32 and 34, a floor 36 or bottom wall, a ceiling 38 or top wall, and shelves 40 in the door 22.

The refrigerator 10 uses a conventional refrigeration loop 42 which includes a compressor 44, a condenser 46, and a plate evaporator 48. The compressor 44 and condenser 46 are positioned in a compartment 50 below the refrigerator compartment 14. The plate evaporator 48 is shown cut away within the freezer compartment 12. The freezer's plate evaporator 48 is mounted beneath the back wall 30, ceiling 38, and floor 36 of the freezer cavity 12. In a top mount refrigerator 10, here detailed, a small section (not shown) of the plate evaporator 48 will extend into the refrigerator compartment 14.

A thermal electric heat pump 52 or thermoelectric device is mounted on the back wall 30 of freezer compartment 12. As is well known, a thermal electric pump 52 is a device that has two parallel surfaces 54 and 66. In response to a voltage potential being applied to thermal electric heat pump 52, a temperature differential develops between surfaces 54 and 66 such that one surface 54 or 66 becomes relatively hot while the opposite surface 66 or 54 becomes relatively cold. By reversing the applied voltage potential, the relatively hot surface 54 or 66 becomes relatively cold, and vice versa. In operation, surface 54 is cooled to a temperature substantially below the walls 30, 32, 34, 36 and 38 of freezer compartment 12. It has been found that by making surface 54 the coldest surface in freezer compartment 12, most of the frost forms on surface 54, thereby leaving the walls 30, 32, 34, 36 and 38 of freezer compartment 12 substantially frost free. By reversing the voltage potential applied to thermal electric heat pump 52, surface 54 is heated, thereby melting any frost 68 or ice formed thereon. Shelf 56 is provided below thermal electric heat pump 52 to collect the water formed by the melting of frost 68 and the water is transferred to pan 64 in compartment 50 through drain 60 and pipe 62.

Figure 2:
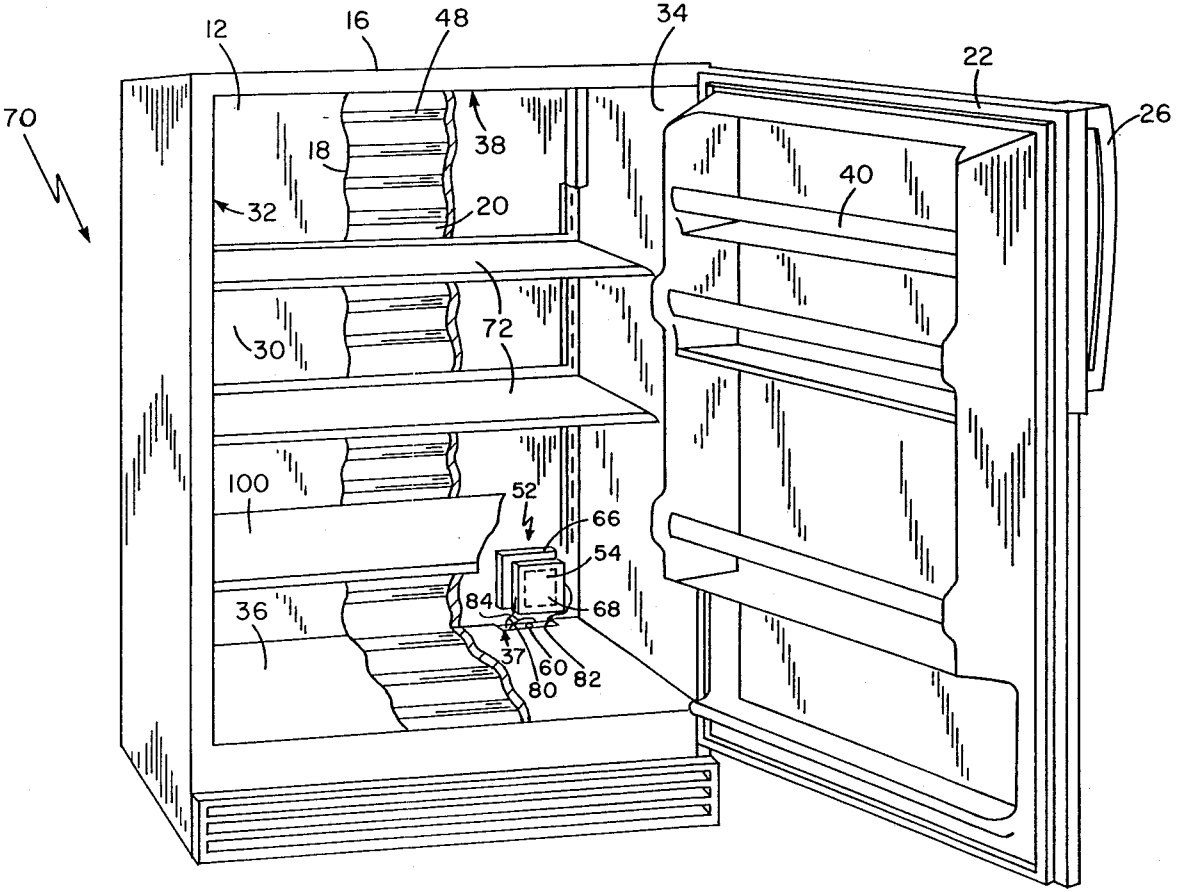
FIG. 2 is a partially broken away front perspective view of an alternate embodiment of the invention in a freezer with the front shelf broken away.

Referring to FIG. 2, there is shown a front perspective view of a freezer 70 with a bottom shelf 100 of a freezer compartment 12 or cavity broken away. As well known, the freezer 70 has an outer metal cabinet 16 made of a type of metal, an inner liner 18, and insulating material 20 sandwiched therebetween (see also FIG. 3). The freezer compartment 12 includes two side walls 32 and 34, a floor 36, a back wall 30, a ceiling 38, and a door 22 with a trough 37. The freezer compartment 12 also includes shelves 72 mounted to the side walls 32 and 34 and shelves 40 mounted in the door 22. The door has a handle 26 for opening. The refrigeration loop (not shown) and circuitry (not shown) is located below the freezer compartment 12. A plate evaporator 48 is mounted behind the surfaces of the ceiling 38, back wall 30, and freezer floor 36 (see also FIG. 3).

Mounted on the surface of the back wall of the freezer compartment 12 is a thermal electric heat pump 52. A more detailed drawing of the heat pump 52 and its surrounding elements is shown in FIG. 3.

Figure 3:
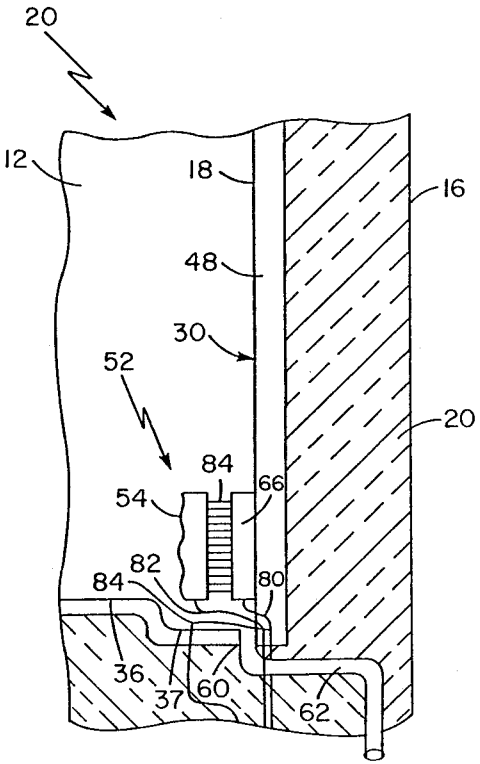
FIG. 3 is a sectioned side elevation view showing the heat pump module of FIG. 2.

Referring to FIG. 3, a section side elevated view is shown of the lower back wall 30 and floor 36 of the freezer compartment 12 in FIG. 2.

Attached to the lower back wall is a thermo electric heat pump 52. The thermal electric heat pump 52 is comprised of three elements: a surface 54, a surface 66, and a series of thermal couples 84 which each contain a series of two different metals bonded together on both ends (not shown). A series of thermo couple 84 ends forms a heat exchange surface 66 and 54. When a positive voltage potential is applied across the series of thermal couples 84, one surface 54 becomes cold relative to the other surface 66. This is known as the Pelteir effect. One such thermo-couple that may be used is Melcor CPl.4-127-06. Surface 54 of this heat pump 52 faces inwardly and communicates with the cavity 12 of the freezer 70. For reasons described later herein, the opposite surface 66 of the heat pump 52 is mounted on to the back wall 30 at the coldest region of the plate evaporator 48. The thermal electric heat pump 52 is attached onto the back wall 30 of the freezer compartment using a thermal conducting cement. Connected to heat pump 52 are two current carrying wires 80 and 82 that provide the electricity for the heat pump 52.

When a voltage is applied across the heat pump 52 through wire 82 and wire 80, the surface 54 of the heat pump 52 becomes cold relative to the surface 66. If the location of the surface 66 is adjacent to the coldest part of the plate evaporator 48, then the surface 54 will be guaranteed to be the coldest spot in the freezer cavity 12. The temperature of this surface 54 is typically 20° F. below the temperature of surface 66 or about 0° F. Frost 68 then forms on this surface 54, thereby substantially limiting the build up of frost on the plate evaporator 48 and freezer walls 30, 32, 34, 36 and 38.

After a period of time, typically 2 hours, the voltage across the thermal electric heat pump 52 is reversed. This reversal is done via the control unit 110 (FIG. 4), which will be explained in more detail herein. Upon reversal, surface 54 now becomes the warm relative to surface 66. Since surface 66 is fixed at the temperature of the plate evaporator 48 typically 20° F., the temperature of surface 54 will be raised to 40° F. or higher. This causes the frost 68 collected on the surface 54 to turn into water, thereby providing an efficient way to melt frost 68 without heating the entire freezer compartment 12.

The back right side of the freezer floor 36 forms a trough 37, and drain 60 is connected to a pipe 62. The water that forms on the surface 54 drips onto the trough 37 or a shelf 56 (FIG. 1) located below the surface 54. Water then collects on the shelf 56 (FIG. 1) or trough 37. Wire 82 supplies electricity to the heat pump 52. Wire 84 runs through the bottom of the trough 37 or shelf 56 (FIG. 1) and is connected to wire 80. This wire 84 is resistive. When the heat pump voltage is reversed, current flows through wire 84 and wire 80 providing heat within the trough 37 or shelf 56 such that melted frost that falls from the heat pump 52 into the trough 37 or shelf 56 (FIG. 1) is prevented from freezing. Water then drains out of the compartment via through drain 60 and pipe 62.

Figure 4:
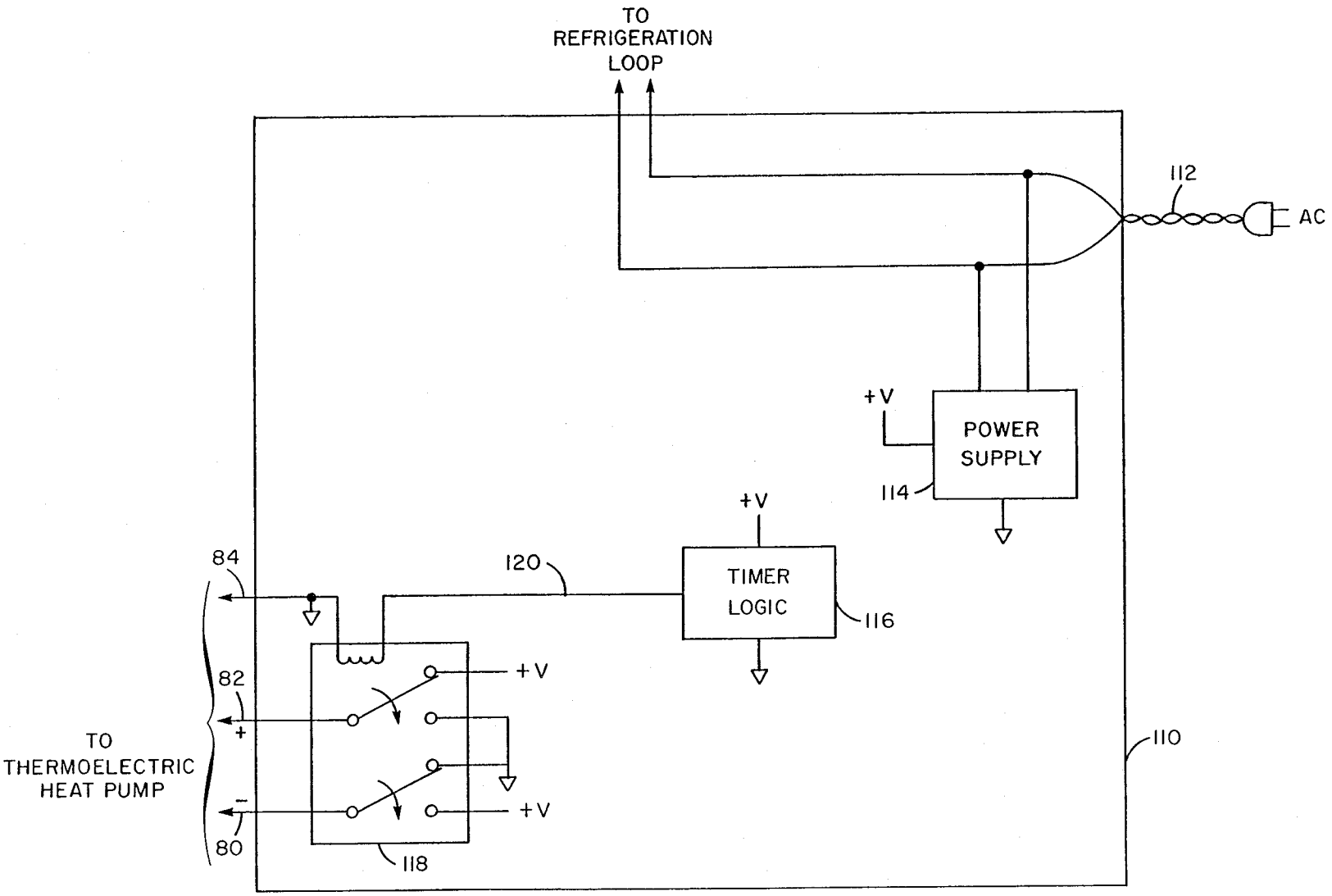
FIG. 4 is an electrical schematic diagram of the control unit for the refrigerator shown in FIG. 1.

Referring to FIG. 4, there is shown a schematic diagram of the control unit 110 seen in FIG. 1 and FIG. 2. This schematic contains an AC wire 112 coming from a 115 volt AC source going to the power supply 114 and the refrigeration loop 42 (FIG. 1). The power supply 114 provides voltage, typically +5 volts at 10 watts, for the thermal electric heat pump 52 (FIG. 1, FIG. 2) via a voltage reversal relay 118, wire 82, and wire 80. The power supply 114 supplies power for the digital timer logic 116. The digital timer logic 116 controls the defrost cycle. More specifically, digital timer logic 116 is connected to a voltage reversal relay 118 via a timer control line 120. The relay 118 between the power supply 114 and the thermal electric heat pump 52 (FIG. 1, FIG. 2) is normally in the closed position which puts a positive voltage across the thermal electric heat pump 52 (FIG. 1 and FIG. 2).

In normal operation, relay 118 is in the state shown in FIG. 4. That is, +V volts such as, for example, 5 volts DC is connected to wire 82. Wires 80 and 84 are grounded. Upon the timer logic 116 timing out after the 2 hour period, a positive voltage is applied to timer output control line 120, which in turn causes the relay 118 to open. Opening of this relay 118 causes +V to be applied to wire 80 while wire 82 is grounded. In other words, opening of relay 118 causes the voltage potential to thermoelectric heat pump 52 to be reversed. The result is that surface 54 (FIGS. 1, 2, and 3) becomes warmer relative to surface 66 (FIGS. 1, 2, and 3). Also, current flows through wires 80 and 84 providing heat within trough 37 (FIG. 3) or shelf 56 (FIG. 1). Further, this reversal will cause the temperature of surface 54 to be raised above freezing, thereby melting the frost 68. The voltage reversal will occur for approximately a 1 minute period. The cycle will end by putting the relay 118 in the closed position.

This concludes the Description of the Preferred Embodiments. A reading of it by those skilled in the art will bring to mind many modifications and alternatives without departing from the spirit and scope of the invention. Accordingly, it is intended that the invention only be limited by the following claims.

What is claimed is:

1. A refrigeration device comprising:

(a) a thermally insulated compartment;

(b) means for cooling said compartment, said cooling means comprising a cooling surface having a predetermined temperature; and (c) means for collecting frost in said compartment, said frost collecting means comprising a first surface in thermal communication with said cooling surface and a second surface for collecting frost, said second surface having a temperature colder than said predetermined temperature and said first surface.

2. The refrigeration device recited in claim 1 further comprising means for periodically raising the temperature of said collecting means above freezing to melt said frost thereby producing water.

3. The refrigeration device recited in claim 2 further comprising means for moving said water from said compartment.

4. The method of defrosting a freezer compartment having an evaporator with a heat exchange surface and a thermoelectric device with first and second heat exchange surfaces, comprising the steps of:

attaching said first surface of said thermoelectric device to said evaporator heat exchange surface;

cooling said second surface to a temperature below said first surface of said thermoelectric device wherein a substantial portion of the frost forming in said freezer forms on said second surface of said thermoelectric device; and periodically raising the temperature of said second surface of said thermoelectric device to melt said frost, thereby producing water.

5. The method of defrosting recited in claim 2 further comprising the step of removing said water from said compartment.

6. A freezer comprising:

(a) a thermally insulated compartment;

(b) a plate evaporator having a heat exchanger surface at a predetermined temperature for cooling said compartment to a freezing temperature; and (c) a thermo-electric device having first and second opposing surfaces, said device being positioned in said compartment, said first surface contacting said plate evaporator and said second surface having a surface temperature below said predetermined temperature wherein a substantial part of the frost forming in said compartment forms on said second surface of said device.

7. The freezer recited in claim 6 further comprising means for periodically heating said second surface to melt frost formed thereon.

8. The freezer recited in claim 7 further comprising means for draining water formed by said melting from said compartment.

9. A freezer comprising:

(a) a thermally insulated compartment;

(b) a refrigeration loop comprising a compressor, condenser, and an evaporator having a surface thermally communicating with said compartment;

(c) a thermo-electric heat pump module having first and second opposing surfaces, said first surface being thermally coupled to said evaporator, said second surface thermally communicating with said compartment; and (d) source of electric voltage potential electrically coupled across said module for cooling said second end to a temperature below said evaporator surface wherein a substantial portion of frost in said compartment forms on the second surface.

10. The freezer recited in claim 9 further comprising means for periodically reversing said potential for raising the temperature of said second surface to melt said frost thereon, thereby producing water.

11. The freezer recited in claim 10 further comprising a drain for removing said water from said compartment.

12. The freezer recited in claim 11 further comprising a shelf located below said second surface for collecting said water and communicating with said drain.

13. Apparatus as recited in claim 9 wherein the temperature differential between said evaporator surfaces and said second surface is about 20° F.

14. The freezer recited in claim 10 wherein said reversing means occurs at a pre-set time interval.

* * * * *